United States Patent [19]

Kupzik

[11] Patent Number: 4,621,601

[45] Date of Patent: Nov. 11, 1986

[54] FUEL INJECTION PUMP IN INTERNAL COMBUSTION ENGINES

[75] Inventor: Roland Kupzik, Nagold, Fed. Rep. of Germany

[73] Assignee: Robert Bosch GmbH, Stuttgart, Fed. Rep. of Germany

[21] Appl. No.: 718,968

[22] Filed: Apr. 2, 1985

[30] Foreign Application Priority Data

May 16, 1984 [DE] Fed. Rep. of Germany ..... 3418174

[51] Int. Cl.[4] ..... F02D 31/00

[52] U.S. Cl. ..... 123/374; 123/372

[58] Field of Search ..... 123/374, 365–373

[56] References Cited

U.S. PATENT DOCUMENTS

| | | | |
|---|---|---|---|
| 3,530,845 | 9/1970 | Staudt et al. | 123/374 |
| 4,085,724 | 4/1978 | Djordjevic et al. | 123/374 |
| 4,132,206 | 1/1979 | Straubel et al. | 123/374 |
| 4,164,925 | 8/1979 | Maier et al. | 123/374 |
| 4,438,746 | 3/1984 | Greiner | 123/373 |
| 4,445,476 | 5/1984 | Eheim | 123/367 |
| 4,463,720 | 8/1984 | Ritter | 123/374 |
| 4,497,295 | 2/1985 | Bruhmann | 123/372 |

FOREIGN PATENT DOCUMENTS

| | | | |
|---|---|---|---|
| 112425 | 9/1979 | Japan | 123/369 |
| 681122 | 10/1952 | United Kingdom | 123/374 |
| 833318 | 4/1960 | United Kingdom | 123/374 |

*Primary Examiner*—Magdalen Y. C. Greenlief

*Attorney, Agent, or Firm*—Edwin E. Greigg

[57] ABSTRACT

A fuel injection pump for internal combustion engines having an arbitrarily actuatable adjustment lever, the movement of which lever is fed as a set-point variable to an rpm governor for the purpose of fuel metering. Between the arbitrary adjustment and its intervention with the rpm governor, for example on the governor spring, there is a coupling device which has a nonlinear relationship between the arbitrary adjustment and the degree of intervention with the rpm governor. This coupling device for generating the nonlinear relationship has a unilateral lever supported in a stationary manner and having an oblong slot in its longitudinal axis, in which slot a guide element, attached to an adjusting device such as an auxiliary adjusting lever to arranged to slide. The arbitrary adjustment engages the adjusting device, and the lever acts upon the rpm governor.

5 Claims, 3 Drawing Figures

FUEL INJECTION PUMP IN INTERNAL COMBUSTION ENGINES

BACKGROUND OF THE INVENTION

The invention is based on a fuel injection pump as defined hereinafter. Especially for self-igniting internal combustion engines, that is, Diesel engines, the fuel must be injected into the combustion chamber of the Diesel engine at high pressure. Such fuel injection pumps are either of the in-line injection pump type, made up of a number of individual pumping elements disposed in a row, in which a separate pumping element is associated with each combustion chamber of the Diesel engine, or else they are of the distributor injection pump type, which have a pumping element on which a distributor piston executes reciprocating and rotating movements and thereby delivers the fuel, which is under pressure, to individual distributor grooves on the jacket surface of the pump cylinders. In the case of the distributor injection pump, one distributor groove is associated with each combustion chamber of the Diesel engine, and the metered fuel proceeds by way of this distributor groove from the pumping element to the associated combustion chamber via an injection nozzle.

All the conventional injection pumps known thus far have an adjusting lever, which within a predetermined engine performance graph regulates the rpm of the Diesel engine linearly and in proportion to its deflection. Since the adjusting lever is actuated arbitrarily, for instance via a Bowden cable or a linkage, the degree to which the rpm governor intervenes in the metered fuel quantity is linearly dependent on the arbitrary actuation. In the low rpm operating range, abrupt changes in operating parameters, especially during the arbitrary actuation, have an unfavorable effect on the transient behavior of an overall system, such as a vehicle, by causing nonuniform surges of movement, generally known as "bucking" or jerking.

OBJECT AND SUMMARY OF THE INVENTION

The injection pump according to the invention and has the advantage over the prior art that the nonlinear relationship between the arbitrary adjustment and the intervention acts upon the rpm governor in the manner of an additional damping in the lower adjustment range. Thus abrupt arbitrary actuations, for instance at the driving pedal of a vehicle, are damped to an increased degree in the lower range, and the coupling device according to the invention acts similarly to a degressive low-pass filter, the input variable of which is the arbitrary actuation, and the output variable of which is the intervention upon the rpm governor. Thus jerking is avoided and the disadvantages of a linear low-pass filter over the entire adjustment range, that is, an overly slow response to arbitrary actuations, do not arise. Although the nonlinearity has a damping effect on transient movements of the overall system, it does not cause any phase displacement between its output and input variable that is perceptible as a delayed response. The coupling device according to the invention is applicable equally well to in-line and distributor type injection pumps.

An advantageous embodiment of the invention provides that the coupling device for generating the nonlinear relationship has a lever supported unilaterally in a stationary manner and having an oblong slot in its longitudinal axis, in which a guide element attached to an adjusting device slides; the arbitrary adjustment engages the adjusting device, and the movement of the lever acts upon the rpm governor. Thus in the lower adjusting range a uniformly abrupt arbitrary actuation has a substantially lesser effect on the rpm governor than in the upper adjusting range, because a part of the arbitrary adjusting path is merely converted into the sliding path of the guide element within the oblong slot.

If the coupling device according to the invention is provided outside the housing, then an advantageous embodiment provides that the adjusting device is embodied as an auxiliary adjusting lever, which together with the lever having the oblong slot embodies a knee-lever arrangement, the knee joint of which slides in the oblong slot and is embodied by the guide element cooperating with the oblong slot. The overall change in length arising in the case of a knee lever arrangement is compensated for in that the guide element slides in the oblong slot, and the nonlinear relationship between the arbitrary deflection of the auxiliary adjusting lever and the pivoting movement of the lever, which intervenes with the rpm governor, is brought about in this manner.

A further advantageous embodiment provides that the adjusting device be embodied as an eccentric arrangement, the eccentric element of which is embodied by the guide element and engages the oblong slot of the lever, which in turn intervenes with the rpm governor. This embodiment is particularly suitable for installation in the interior of the pump housing. The adjusting device and the eccentric element are located in the interior of the pump housing and are secured to the adjusting shaft passing all the way through the pump housing. The lever having the oblong slot is supported unilaterally such that it is rotatable but stationary and it acts upon the so-called governor spring. In this embodiment, the adjusting forces remain constant over the entire arbitrary adjusting range, so that for the driver of a vehicle in which the coupling device according to the invention is realized, there are no recognizable differences when the driving pedal is arbitrarily actuated.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
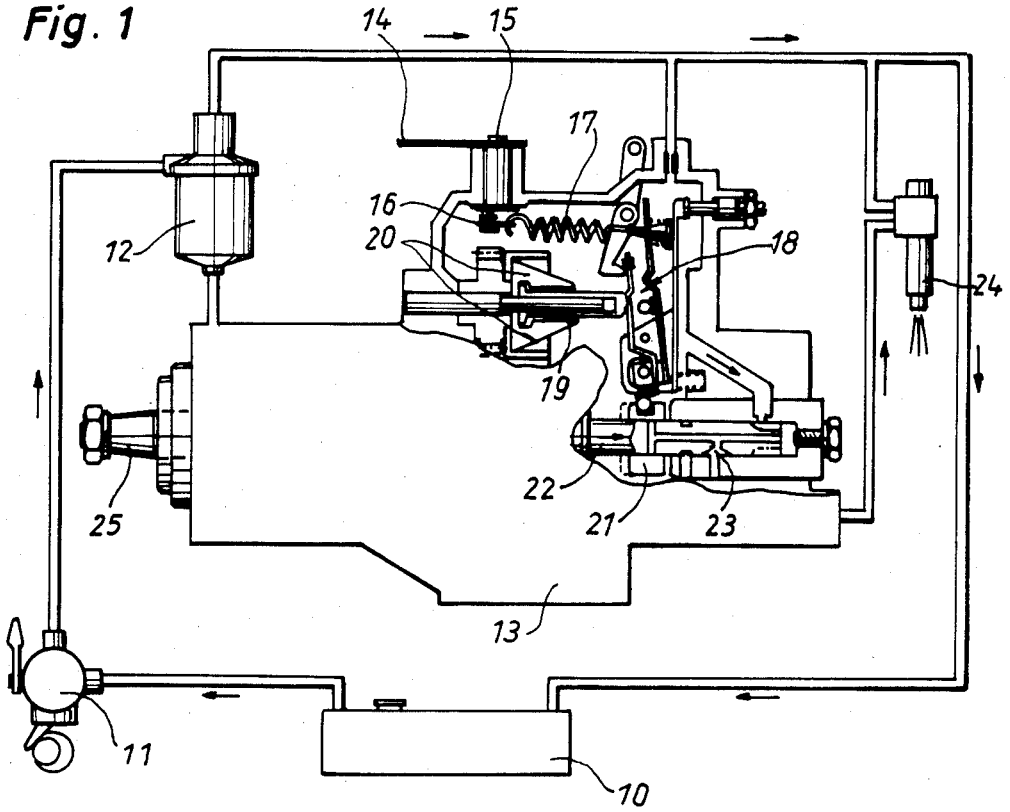
FIG. 1 schematically shows a fuel injection system having a distributor injection pump known per se, in which the rpm governor is shown, so as to show clearly the mode of operation of the coupling device according to the invention.

In the fuel injection system shown in FIG. 1, fuel is delivered from a fuel container 10 via a pre-supply pump 11 and a fuel filter 12 to a distributor injection pump. The pump housing 13 is shown partially cut away so that the elements of the rpm governor are visible. Via an adjusting lever 14, an adjusting shaft 15 passing through the pump housing 13 and an eccentric element 16, the arbitrary adjustment engages the governor spring 17, which in turn is connected with the governor lever arrangement 18. The governor sleeve 19, which is deflected in accordance with rpm by the flyweight assembly 20, also acts upon the governor lever arrangement 18. The governor lever arrangement displaces the governor slide 21 on the shaft of the distributor piston 21. Its axial displacement determines the quantity of fuel supplied at high pressure, which is delivered via distributor grooves 23 to injection nozzles 24 for injection into the combustion chambers of a Diesel engiene. The injection pump is driven in synchronism with the engine rpm at its drive shaft 25.

The coupling device according to the invention causes the arbitrary actuation engaging the adjusting lever 14 via the adjusting shaft 15 to be transmitted nonlinearly to the governor spring 17 or the governor lever arrangement 18. The coupling device may either be disposed outside the pump housing, in which case it operates between the adjusting lever 14 and where the arbitrary actuation takes effect, or it can be installed in the interior of the pump housing, in which case it should be disposed between the eccentric element 16 and the governor spring 17.

Figure 2:
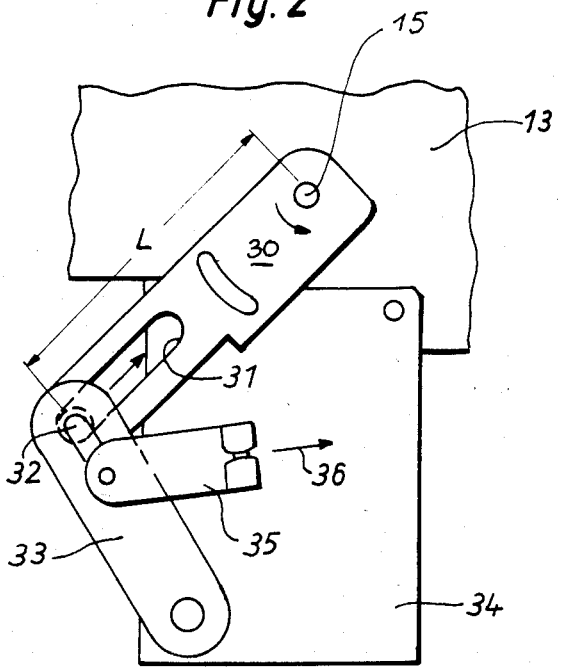
FIG. 2 shows a detail of an embodiment for use outside the pump housing.

FIG. 2 shows an exemplary embodiment in which the nonlinear coupling device is attached outside the pump housing. A lever 30 is secured to the adjusting lever 15 of the injection pump, having an oblong slot 31 in its lower portion. A guide element 32, which may for instance be embodied as a roller, slides in the oblong slot 31. The guide element 32 is located at the end of an auxiliary adjusting lever 33, which is rotatably supported in a manner stationary on the pump housing 13 on a base plate 34. The traction 36 of the arbitrary adjustment engages the auxiliary adjusting lever via an intermediate part 35. The lever 30 and the auxiliary adjusting lever 33 together embody a knee-joint arrangement, in which the knee joint comprises the oblong slot 31 together with the guide element 32. However, the position of the knee joint and thus the effective length L of the lever 30 shift whenever the arbitrary actuation deflects the traction 36. The longer the effective length L of the lever 30, the less the effect of a traction 36 upon the adjusting shaft 15, so that the nonlinear transmission of the arbitrary actuation from the traction 36 to the adjusting shaft 15 is effected by the sliding of the guide element 32 in the oblong slide 31, because the effective length L of the lever 30 decreases with an increasing deflection.

Figure 3:
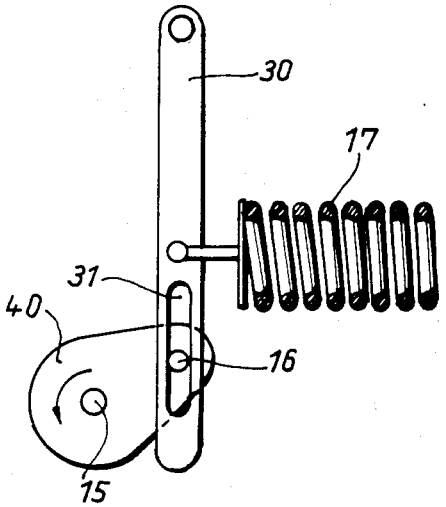
FIG. 3 shows another detail of the fundamental structure of an embodiment disposed inside a pump housing.

In FIG. 3, an embodiment of the coupling device according to the invention which is located inside the pump housing is shown schematically. An eccentric device 40, which carries the eccentric element 16, is located on the adjusting shaft 15 in the interior of the pump. However, the eccentric element 16 does not engage the governor spring 17 directly, but instead acts as the guide element in the oblong slot 31 of the lever 30. The lever 30 in this exemplary embodiment is supported at one end in the interior of the pump housing such that it is movable at its end.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines having a housing, an arbitrarily actuable adjusting lever, the movement of which can be fed in the form of a set-point variable into an rpm governor for the purpose of fuel metering, comprising a coupling device disposed between said arbitrarily actuable adjusting lever and said rpm governor, said coupling device generates a non-linear relationship between said arbitrarily adjusting lever and a degree of intervention with said rpm governor, said coupling device includes a lever having an oblong slot in its longitudinal axis, said lever being supported unilaterally and supported at one end, a guide element slidably supported in said oblong slot wherein said arbitrarily adjusting lever engages an adjusting device and movement of said lever is imparted to said rpm governor, said adjusting device comprises an auxiliary adjusting lever arranged to cooperate with said oblong slotted lever by means of a knee-lever arrangement, said knee-lever arrangement having a knee joint which slides in said oblong slot.

2. A fuel injection pump as defined by claim 1, further wherein said adjusting device further includes an eccentric means, one element of said eccentric means is embodied by said guide element and is arranged to engage the oblong slot of said lever.

3. A fuel injection pump as defined by claim 1, further wherein said guide element comprises roller means.

4. A fuel injection pump as defined by claim 2, further wherein said eccentric means is disposed inside said pump housing and is arbitrarily actuatable via an adjusting shaft which extends through said pump housing.

5. A fuel injection pump as defined by claim 1, further wherein said auxiliary adjusting lever is supported at one end on a means secured to said pump housing and cooperates via said knee joint with said slotted lever, said slotted lever arranged to engage an adjusting shaft whereby arbitrary actuation is effected at said auxiliary adjusting lever.

* * * * *